US008869765B2

(12) United States Patent
Braeuchle

(10) Patent No.: US 8,869,765 B2
(45) Date of Patent: Oct. 28, 2014

(54) IGNITION SYSTEM AND METHOD FOR IGNITING FUEL IN A VEHICLE ENGINE BY MEANS OF A CORONA DISCHARGER

(75) Inventor: Gerd Braeuchle, Hueffenhardt (DE)

(73) Assignee: BorgWarner BERU Systems GmbH, Ludwigsburg (DE)

( * ) Notice: Subject to any disclaimer, the term of this patent is extended or adjusted under 35 U.S.C. 154(b) by 698 days.

(21) Appl. No.: 13/217,664

(22) Filed: Aug. 25, 2011

(65) Prior Publication Data

US 2012/0055430 A1 Mar. 8, 2012

(30) Foreign Application Priority Data

Sep. 4, 2010 (DE) ..... 10 2010 045 168

(51) Int. Cl.

| | |
|---|---|
| ***F02P 23/00*** | (2006.01) |
| ***F02P 23/04*** | (2006.01) |
| *F02D 41/20* | (2006.01) |
| *F02P 9/00* | (2006.01) |

(52) U.S. Cl.

CPC ..... *F02P 23/045* (2013.01); *F02D 2041/2027* (2013.01); *F02P 9/002* (2013.01); *F02D 2200/503* (2013.01)

USPC ..... 123/143 B

(58) Field of Classification Search

USPC ..... 123/143 B, 143 A, 594, 596, 598, 160, 123/606

See application file for complete search history.

(56) References Cited

U.S. PATENT DOCUMENTS

| | | | | |
|---|---|---|---|---|
| 3,331,986 | A * | 7/1967 | Hardin et al. | 315/200 R |
| 4,341,195 | A * | 7/1982 | Nishio et al. | 123/598 |
| 6,662,793 | B1 | 12/2003 | Allen et al. | |
| 8,640,665 | B2 * | 2/2014 | Trump | 123/143 B |
| 2010/0206277 | A1 | 8/2010 | Kajita | |

FOREIGN PATENT DOCUMENTS

| | | | |
|---|---|---|---|
| DE | 100 48 053 | A1 | 6/2002 |
| EP | 1 515 594 | A2 | 3/2005 |

* cited by examiner

*Primary Examiner* — Hieu T Vo

(74) *Attorney, Agent, or Firm* — Hackler Daghighian & Martino

(57) ABSTRACT

The invention relates to an ignition system for the ignition of fuel in a vehicle engine by means of a corona discharge, comprising a voltage converter which has an input side for connection to a voltage source, and an output side, and an electric oscillating circuit connected to the secondary side for HF excitation of an ignition electrode. According to the invention, by an energy accumulator for charging from the electrical system of a vehicle, the energy accumulator being connected to the input side of the voltage converter to even out the electrical system load. The invention furthermore relates to a method according to the invention for the ignition of fuel.

10 Claims, 2 Drawing Sheets

IGNITION SYSTEM AND METHOD FOR IGNITING FUEL IN A VEHICLE ENGINE BY MEANS OF A CORONA DISCHARGER

The invention refers to an ignition system for igniting fuel in a vehicle engine by means of a corona discharge. Such ignition systems are usually referred to as corona or HF ignition systems. The invention furthermore relates to a method for igniting fuel in a vehicle engine by means of a corona discharge. Such an ignition system and a corresponding method are known from EP 1 515 594 A2.

HF ignition systems generate—on the basis of a vehicle system voltage using a voltage converter, e.g. a transformer—a high voltage which is used for the HF excitation of an electric oscillating circuit to which the ignition electrode is connected. HF ignition systems therefore have a voltage converter that comprises an input side for connection to the electrical system of a vehicle, and an output side which is connected to an electric oscillating circuit for HF excitation of an ignition electrode. The resonant frequency of the oscillating circuit is typically between 30 KHz and 3 MHz. The alternating voltage typically reaches values between 50 kV to 500 kV at the ignition electrode.

The ignition of fuel using corona discharges is an alternative to conventional spark plugs which induce ignition by means of an arc discharge and are subject to considerable wear due to electrode erosion. Corona ignitions have the potential to reduce costs considerably and improve fuel combustion. However, HF ignition systems have a high power demand and therefore place a considerable load on the electrical system of a vehicle.

The problem addressed by the present invention is that of demonstrating a way to reduce the load on a vehicle electrical system during operation of an HF ignition system.

SUMMARY OF THE INVENTION

An ignition system according to the invention comprises an energy accumulator for charging from the electrical system of the vehicle, which is connected to the input side of the voltage converter, e.g. the primary side of a transformer, to even out the electrical system load. In the case of an ignition system according to the invention, the energy required to generate a corona discharge, which occurs in a pulsed manner in accordance with the engine phase, can therefore be covered at least partially from the energy accumulator of the ignition system. Given that the energy accumulator is charged between the current pulses supplied to the input side of the voltage converter, the electric energy required for the individual current pulses can be taken from the electrical system of the vehicle over a longer period of time and, therefore, more evenly. A pulse-type load, which is problematic for the vehicle electrical system, i.e. drawing large currents in short time intervals, can therefore be reduced using an ignition system according to the invention, and can be replaced by a more even load, namely drawing smaller currents over a longer period of time.

The energy accumulator of an ignition system according to the invention is preferably a capacitor. Capacitors can advantageously release stored electric energy in a short period of time and are therefore well suited to generating current pulses, which must be supplied to the input side of a voltage converter to generate a corona discharge.

In a method according to the invention for igniting fuel in a vehicle engine using a corona discharge, an electric oscillating circuit connected to an ignition electrode is excited via a voltage converter connected to the electrical system of the vehicle. The voltage converter is supplied from the energy accumulator which is charged via the electrical system. To utilize the advantages of the present invention, it is not necessary to supply the voltage converter entirely from the energy accumulator. A pulsed load per se is not problematic for the electrical system provided the current intensity of the individual pulses is not too large. Preferably, however, the voltage converter draws the majority of electric energy released in a corona discharge from the energy accumulator.

To attain the most even load possible on the electrical system, the energy accumulator preferably draws energy from the electrical system between two consecutive corona discharges and also during the corona discharges.

Preferably an ignition system according to the invention comprises a current limiter for limiting the maximum current intensity when charging the energy accumulator. In this manner, the load on the electrical system associated with the charging of the energy accumulator can be evened out even further. In the simplest case, such a current limiter can be provided in the form of an ohmic resistor.

According to an advantageous refinement of the invention, a control unit is provided that controls the charging of the energy accumulator. For example, the energy accumulator can be charged using a method of pulse-width modulation. During consecutive periods of duration T, the control unit couples the energy accumulator to the vehicle electrical system for time intervals t in each period. Charging current pulses having duration t are generated as a result. When the energy accumulator is charged using pulse-width modulation, the duration of current pulses t used to charge the energy accumulator, or the time duration T should be so short that, during one working cycle of the engine, at least 10, preferably at least 20, in particular at least 50 current pulses supply energy to the energy accumulator. Preferably, a frequency of a least one kHz is used for the pulse-width modulation.

Preferably, the duration of the current pulses during charging of the energy accumulator increases during the working cycle of the engine until discharge occurs once more. When an energy accumulator, in particular a capacitor, is charged, the current intensity of the charging current typically decreases as the load increases. When charging is carried out using pulse-width modulation, the load on the electrical system can therefore be distributed more evenly across the working cycle of the engine by increasing the pulse duration of the charging current pulses as charging progresses. Preferably, the on/off ratio t/T is lowest immediately after energy is drawn to generate a corona discharge, and increases until the next time when energy is drawn to generate the next corona discharge. The control unit preferably monitors the state of charge of the energy accumulator and controls the charging current thereof with consideration for the state of charge.

In a further advantageous refinement of the invention, the intensity and/or the course of a charging current over time, with which the energy accumulator is charged via the electrical system, is controlled depending on the speed of the engine, e.g. in that the control unit specifies the duty factor t/T and/or the period T for charging using a method of pulse-width modulation. Since the interval between the corona discharges is specified by the engine speed, optimal use of the time that is available for charging the energy accumulator can be made in this manner, and so the load on the electrical system associated with charging can be distributed across the longest period of time possible.

In another advantageous refinement of the invention, the charging current is controlled depending on an expected demand for ignition energy, The ignition energy required to ignite the fuel depends on the operating state of the engine. By evaluating the state data of the engine, e.g. engine load, speed, quantity of fuel injected, and/or engine temperature, an expected demand for ignition energy can therefore be determined, In the simplest case, the value of the energy consumed in the last ignition can be used as the value for the expected energy demand for the next ignition. Given that the expected demand for ignition energy is supplied to the energy accumulator during a working cycle, the load on the electrical system can be evened out further.

In a method according to the invention, the energy accumulator can be charged to the same state of charge—fully charged, for instance—in every working cycle of the engine. To even out the load on the electrical system, it can also be advantageous, however, to utilize the working accumulator to balance out different demands for ignition energy, and to change the quantity of energy that is drawn from the electrical system during one working cycle slowly or not at all. Preferably, the energy accumulator is charged with the energy demand expected for the next ignition. The expected energy demand can be determined on the basis of engine data such as the course of speed, load, and/or injection quantity. The expected demand for ignition energy can also be determined by extrapolating the demand for ignition energy of previous ignitions.

BRIEF DESCRIPTION OF THE DRAWINGS

Further details and advantages of the present invention are explained using an embodiment, with reference to the attached drawings. In the drawings.

DETAILED DESCRIPTION

Figure 1:
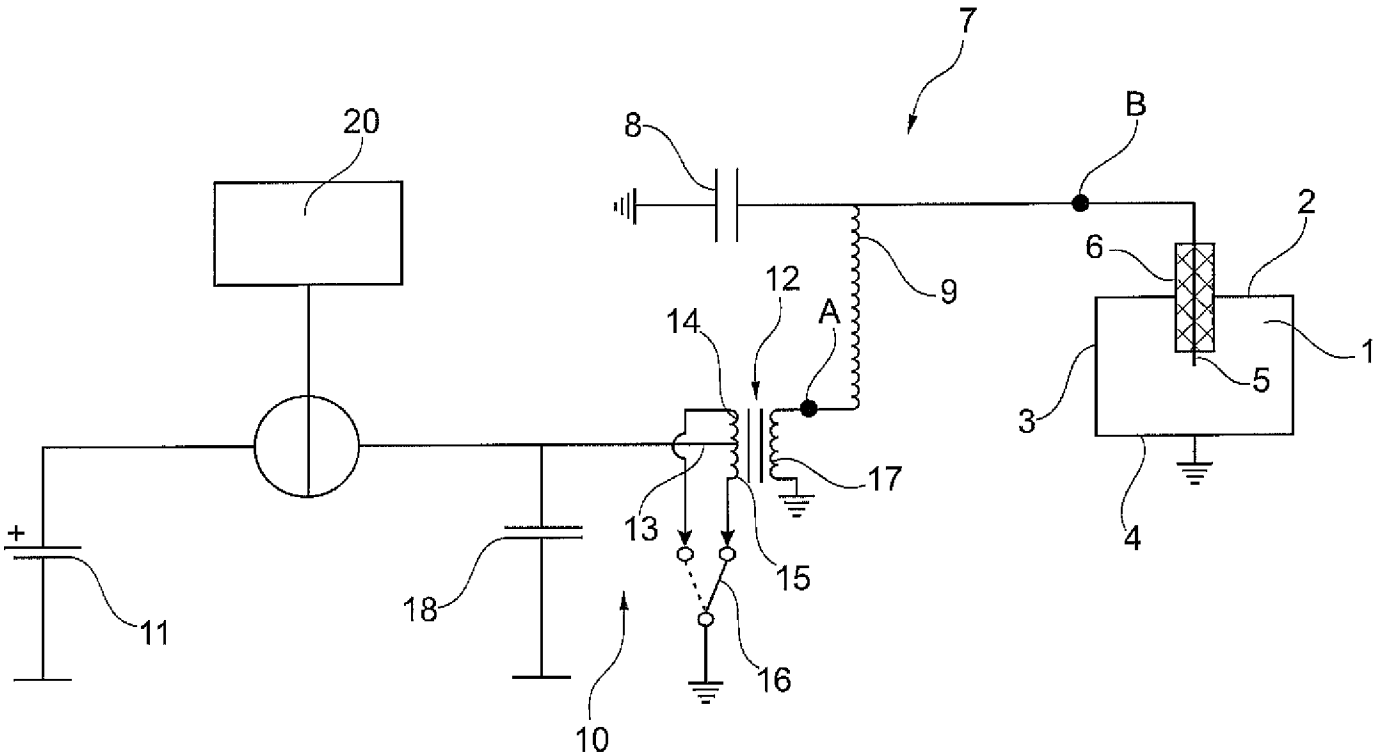
FIG. 1 shows a schematic depiction of an ignition system according to the invention.

FIG. 1 shows a schematic depiction of a combustion chamber 1 of a cyclically operating internal combustion engine. The combustion chamber is delimited by walls 2, 3, 4 which are at ground potential. An insulator 6 that carries an ignition electrode 5 extends into combustion chamber 1. Ignition electrode 5 is electrically insulated by insulator 6 with respect to walls 2, 3, 4. Ignition electrode 5 and walls 2, 3, 4 of combustion chamber 1 are part of a series oscillating circuit 7 which also includes a capacitor 8 and an inductor 9. Of course, series oscillating circuit 7 can also comprise further inductors and/or capacitors, and other components that are known to a person skilled in the art as possible components of oscillating circuits.

A high-frequency generating unit for the excitation of oscillating circuit 7, such as a high-frequency generator 10, is provided, which comprises a voltage converter, preferably a transformer 12 having a center tap 13 on the input or primary side thereof, thereby enabling two primary windings 14, 15 to meet at center tap 13. Using a high-frequency switch 16, the ends of primary windings 13, 15 opposite center tap 13 are connected to ground in alternation. The switching rate of high-frequency switch 16 determines the frequency with which oscillating circuit 7 is excited, and can be changed. Secondary winding 17 of transformer 12 supplies oscillating circuit 7 at point A. The high-frequency switch can be controlled using a not-shown closed control loop such that the oscillating circuit is excited with the resonant frequency thereof. The voltage between the tip of ignition electrode 5 and walls 2, 3, 4 that are at ground potential is then at a maximum.

During operation, the primary side of transformer 12 is connected to the vehicle electrical system which is represented by a battery 11 in FIG. 1. For the duration of an ignition pulse, a voltage pulse having the resonant frequency of the igniter is applied to the primary side of transformer 12, in order to generate a corona discharge in the combustion chamber. The duration and voltage of the pulse depend on the engine state, in particular the speed and engine load, and fuel quantity. The energy transmitted via transformer 12 is therefore highly variable. The effective current that is drawn from the electrical system is therefore variable as well. The current pulses that would be drawn from the electrical system during a pulse are depicted in FIG. 2.

Figure 2:
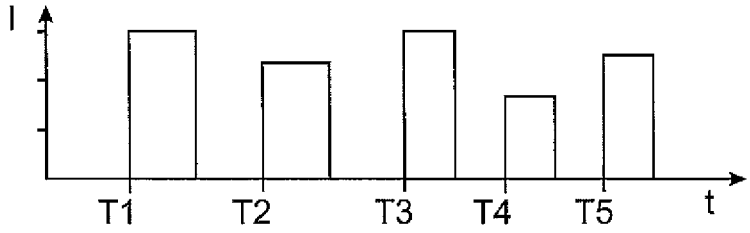
FIG. 2 shows the current pulses to be applied to the primary side of the transformer to generate a corona discharge.

If the current pulses depicted in FIG. 2 would be drawn directly from the vehicle electrical system, it would be loaded disadvantageously. Specifically, the current intensities of the individual pulses typically amount to a few 10 A. If a vehicle electrical system experiences a strong pulse load, voltage fluctuations occur, which can be problematic for other consumers in the vehicle.

To even out the load on the electrical system, an energy accumulator 18, preferably a capacitor, is connected to the primary side of transformer 12 in the ignition system depicted in FIG. 1. The current pulses supplied to the primary side of transformer 12, which are depicted schematically in FIG. 2, can therefore be drawn from energy accumulator 18.

In the embodiment shown, the energy for a corona discharge is drawn entirely from energy accumulator 18. It is also possible, however, to provide the energy accumulator only for support purposes. Then the energy of a current pulse supplied to the primary side of transformer 12 is drawn only partially from energy accumulator 18 and partially directly from the vehicle electrical system.

The current drawn from the electrical system is controlled via pulse-width modulation by a control unit 20. Control unit 20 controls the intensity and/or the course of the charging current over time, with which energy accumulator 18 is charged via the electrical system, depending on the operating state of the engine, e.g. the engine speed and/or other engine data. Control unit 20 also monitors the state of charge of energy accumulator 18 and takes the state of charge into account when controlling the charging current.

To even out the load on the electrical system to the greatest extent possible, the charging current of energy accumulator 18 can also flow during an ignition procedure. If the charging current is pulse-width modulated, it is advantageous to extend the duration of the charging current pulses as the charge of energy accumulator 18 increases.

Figure 3:
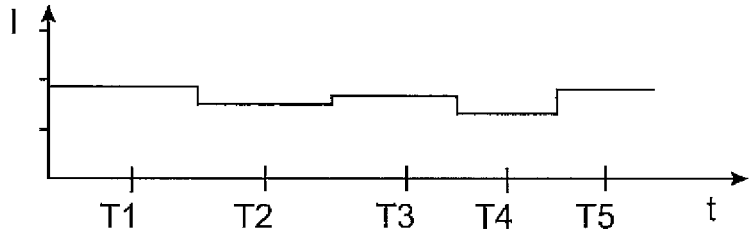
FIG. 3 shows an example of a current demand of an ignition system according to the invention.

As shown in FIG. 2, the energy demand for igniting fuel is not constant. The current pulses supplied to the primary side of transformer 12 therefore differ from one another. This can result in a fluctuating load on the electrical system, as depicted schematically in FIG. 3. FIG. 3 shows the effective current intensity that is drawn from the electrical system by the ignition system shown. The effective current intensity is generated by a method of pulse-width modulation. Pulse duration t and period T are selected to be substantially shorter in pulse-width modulation than the duration of one working cycle, and so a plurality of current pulses occur during one working cycle, preferably at least 10, in particular at least 20, and the time intervals between the individual current pulses are so short that the electrical system undergoes a quasi uniform load by an effective current intensity that results from the on/off ratio of the pulse-width modulation.

FIG. 3 shows a largely uniform load on the electrical system that changes in a stepped manner in each working cycle. Rates of repetition and energy demand of the individual ignitions are not constant, and so the charging current must be adapted to these parameters. This is possible since the rates of repetition are given by the known speed and the moment of ignition of the internal combustion engine, and therefore the charging time can be determined directly from the speed. The required energy demand depends on the particular engine operating state and can be determined from application data. By way of this information, the energy demand for the next ignition pulse and the time until this ignition pulse are specified; by taking this information into account it is therefore possible to control the charging current given the requirement to load the electrical system as evenly as possible during the working cycle, as depicted schematically in FIG. 3.

Figure 4:
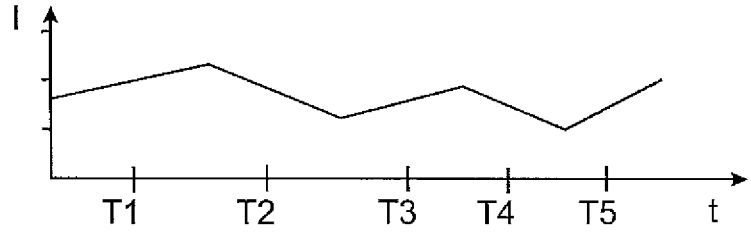
FIG. 4 shows a further example of the current demand of an ignition system according to the invention.

If the charging current is not adjusted immediately, and is adjusted slowly instead, the current ripple (amplitude) becomes greater as shown in FIG. 4, but the gradients of the current change are lower. The course of charging current depicted schematically in FIG. 4 therefore results. The adaptations of the charging current to a new value therefore do not need to be performed in a linear manner, as shown in FIG. 4, but rather can be carried out exponentially, for instance, or in another manner. In particular, it can also be advantageous to not adapt the charging current to changed conditions after every working cycle of the engine, but only after a specified number of charging cycles, such as five or more working cycles. In this case, it is advantageous to design energy accumulator 18 to be slightly larger than is required for the maximum energy demand for ignition.

Abrupt adjustments in the charging current can also be prevented, in particular, by monitoring the engine state and predicting a change in the energy demand in advance on the basis of the gas pedal position or speed change, for example. The charging current can then be adjusted proactively.

REFERENCE NUMERALS

1 Combustion chamber
2, 3, 4 Walls
5 Ignition electrode
6 insulator
7 Series oscillating circuit
8 Capacitor
9 Inductor
10 High-frequency generator
11 Battery
12 Voltage converter
13 Center tap
14, 15 Primary windings
16 High-frequency switch
17 Secondary winding
18 Energy accumulator
19 Resistor
20 Control unit
21 Switch

What is claimed is:

1. A method for igniting fuel in a vehicle engine by means of a corona discharge, the method comprising:

exciting an electric oscillating circuit, connected to an ignition electrode, via a voltage converter connected to an electrical system of the vehicle; and supplying the voltage converter with energy from an energy accumulator, said energy accumulator being charged via the electrical system.

2. The method according to claim 1, wherein the voltage converter draws the majority of electric energy released in the corona discharge from the energy accumulator.

3. The method according to claim 1, wherein the energy accumulator draws energy from the electrical system between two consecutive corona discharges and also during the corona discharges.

4. The method according to claim 1, wherein the intensity and/or the course of the charging current over time, with which energy accumulator is charged via the electrical system is controlled depending on the engine speed.

5. The method according to claim 1, wherein the energy accumulator is charged using a method of pulse-width modulation.

6. The method according to claim 1, wherein the charging current of the energy accumulator is controlled in dependence of its state of charge.

7. The method according to claim 1, wherein the energy accumulator is charged with a plurality of charging current pulses during a working cycle of the engine, the duration of the charging current pulses being extended as the charging progresses.

8. The method according to claim 1, wherein an energy demand of the next ignition is determined, and the charging current with which the energy accumulator is charged via the electrical system is controlled depending on the determined energy demand.

9. The method according to claim 1, wherein the energy demand is determined on the basis of engine data.

10. The method according to claim 1, wherein the energy demand is determined via extrapolation of the energy demand of preceding ignitions.

* * * * *